United States Patent [19]

Causton

[11] Patent Number: 4,519,852

[45] Date of Patent: May 28, 1985

[54] ANNEALING OF HIGH SPEED STEEL POWDER

[75] Inventor: Robert J. Causton, Delran, N.J.

[73] Assignee: Davy McKee (Sheffield) Limited, Sheffield, England

[21] Appl. No.: 459,503

[22] Filed: Jan. 20, 1983

[30] Foreign Application Priority Data

Jan. 21, 1982 [GB] United Kingdom ..... 8201699

[51] Int. Cl.[3] ..... B22F 0/1

[52] U.S. Cl. ..... 148/16; 148/126.1

[58] Field of Search ..... 148/16, 126.1

[56] References Cited

U.S. PATENT DOCUMENTS 4,385,929 5/1983 Ichidate et al. ..... 148/126.1

FOREIGN PATENT DOCUMENTS 54-49906 4/1979 Japan ..... 148/126.1

676384 7/1979 U.S.S.R. ..... 148/126.1

*Primary Examiner*—Veronica O'Keefe

*Attorney, Agent, or Firm*—Schwartz & Weinrieb

[57] ABSTRACT

In order to anneal high speed steel powder having a hardness of the order of about 550 to 600 Vickers and an oxygen content of 1500–2000 ppm, the powder is heated to a maximum temperature of about 1050° C. and held at that temperature for about one hour. The powder is then gas quenched to between 700° and 780° C., held at that temperature for about one hour, and finally gas quenched to ambient temperature.

8 Claims, No Drawings

ANNEALING OF HIGH SPEED STEEL POWDER

FIELD OF THE INVENTION

This invention relates to a method of annealing high speed steel powder.

BACKGROUND OF THE INVENTION

High speed steels are high carbon, high alloy tool steels and, as a typical example, a high speed steel known as M2 includes 6% tungsten, 5% molybdenum, 4% chromium, 2% vanadium and about 0.85% carbon with the balance being mainly iron.

Liquid high speed steel can be atomised by a water atomising technique to produce powder, but it has been found that this powder cannot readily be compressed into compacts because the powder is too hard. The hardness of the powder is typically 550–600 Vickers. Furthermore, the oxygen content of water atomised powder is of the order of 1500–2000 parts per million and, with this amount of oxygen present, the powder cannot easily be sintered.

It is known to anneal this powder in order to reduce its hardness and to lower its oxygen content, but the known annealing process has a cycle time of the order of twenty four hours. The annealing cycle comprises heating the powder to 1050° C. and then allowing it to cool at a rate of between 15° and 25° per hour to 550°. This part of the annealing cycle takes up approximately twenty hours and, from 550° C., the powder is cooled to ambient temperature. The complete cycle is of the order of twenty four hours and it is conducted under vacuum or a reducing atmosphere.

OBJECT OF THE INVENTION

Clearly, such a long cycle time is undesirable and it is an object of the present invention to provide an annealing process for high speed steel powder which operates on a much shorter cycle time.

DETAILED DESCRIPTION OF THE PREFERRED EMBODIMENT

According to the present invention, a process for annealing high speed steel powder having a hardness of the order of 550–600 Vickers and an oxygen content of 1500–2000 parts per million comprises heating a quantity of the powder to a maximum temperature of about 1050° C., holding the powder at that maximum temperature for about one hour, gas quenching the powder to rapidly reduce the temperature thereof to an intermediate temperature of between 700°–780° C., holding the powder at that intermediate temperature for about one hour and gas quenching the powder to rapidly reduce the temperature thereof to ambient.

It has been found that the rapid heat transfer of the powder, from maximum temperature to an intermediate soak temperature, and the subsequent rapid heat transfer from the soak temperature to ambient temperature, produces an annealed powder which is soft enough to enable it to be compacted and have a sufficiently low oxygen profile.

The heat soaking of the powder, at the maximum and intermediate temperatures, is conveniently carried out under vacuum, but a hydrogen atmosphere may be substituted.

The rapid quenching of the powder is conveniently carried out by a nitrogen gas flow.

EXAMPLE

In a typical example of the annealing process according to the present invention, a quantity of M2 powder produced by a water atomisation process and having a hardness of the order of 550–600 Vickers and an oxygen content of 1500–2000 parts per million is heated under vacuum to 1050° C. This takes about one and a half hours. The temperature is kept at a soaking temperature for one hour and, thereafter, nitrogen is caused to flow through the powder to quench it as rapidly as possible to a temperature in the range 700°–780° C. This temperature is retained as a second soaking temperature for a further hour and the powder is then again rapidly quenched by nitrogen to ambient temperature.

The complete annealing cycle is thus of the order of six hours and, at the end of the cycle, the hardness of the powder is less than 250 Vickers and the oxygen content is less than 600 parts per million.

Obviously, many modifications and variations of the present invention are possible in light of the above teachings. It is therefore understood that within the scope of the appended claims, the present invention may be practiced otherwise than as specifically described herein.

What I claim as my invention and desire to secure by Letters Patent is:

1. A process for annealing a predetermined quantity of high speed steel powder having a hardness of the order of 550–600 Vickers and an oxygen content of 1500–2000 parts per million, comprising the steps of:

heating said predetermined quantity of said powder to a maximum temperature of approximately 1050° C.;

holding said predetermined quantity of powder at said maximum temperature for approximately one hour;

quenching said predetermined quantity of powder with a non-oxidizing gas so as to rapidly reduce the temperature of said predetermined quantity of powder to an intermediate temperature value of between 700°–780° C.;

holding said predetermined quantity of powder at said intermediate temperature value of between 700°–780° C. for approximately one hour; and quenching said predetermined quantity of powder with a non-oxidizing gas so as to rapidly reduce the temperature of said predetermined quantity of powder to ambient.

2. A process as claimed in claim 1, in which the powder is held at the maximum and intermediate temperatures under vacuum.

3. A process as claimed in claim 1, in which the powder is held at the maximum and intermediate temperatures in a hydrogen atmosphere.

4. A process as claimed in claim 1, in which the gas used for quenching the powder is nitrogen.

5. A process for annealing a predetermined quantity of high speed steel powder having a hardness of the order of 550–600 Vickers and an oxygen content of 1500–2000 parts per million, comprising the steps of:

heating said predetermined quantity of said powder to a maximum temperature of approximately 1050° C.;

holding said predetermined quantity of powder at said maximum temperature for approximately one hour;

quenching said predetermined quantity of powder with an inert gas so as to rapidly reduce the temperature of said predetermined quantity of powder to an intermediate temperature value of between 700°–780° C.;

holding said predetermined quantity of powder at said intermediate temperature value of between 700°–780° C. for approximately one hour; and quenching said predetermined quantity of powder with an inert gas so as to rapidly reduce the temperature of said predetermined quantity of powder to ambient.

6. A process as set forth in claim 5, wherein:

said inert gas is nitrogen.

7. A process as set forth in claim 5, wherein:

said predetermined quantity of powder is held at said maximum and intermediate temperature values under vacuum conditions.

8. A process as set forth in claim 5, wherein:

said predetermined quantity of powder is held at said maximum and intermediate temperature values in a hydrogen atmosphere.

* * * * *